US011679323B1

(12) United States Patent
Bordenkircher

(10) Patent No.: US 11,679,323 B1
(45) Date of Patent: Jun. 20, 2023

(54) FOLDABLE SELF-ALIGNING BILLIARD BALL RACK

(71) Applicant: Francis Leo Bordenkircher, Coshocton, OH (US)

(72) Inventor: Francis Leo Bordenkircher, Coshocton, OH (US)

( * ) Notice: Subject to any disclaimer, the term of this patent is extended or adjusted under 35 U.S.C. 154(b) by 0 days.

(21) Appl. No.: 17/561,193

(22) Filed: Dec. 23, 2021

(51) Int. Cl.
*A63D 15/00* (2006.01)

(52) U.S. Cl.
CPC ..... *A63D 15/005* (2013.01)

(58) Field of Classification Search
CPC ..... A63D 15/005
USPC ..... 473/40, 41
See application file for complete search history.

(56) References Cited

U.S. PATENT DOCUMENTS 1,089,140 A * 3/1914 Madigan ..... A63D 15/005 473/40
1,161,324 A * 11/1915 Matthay ..... A63B 23/16 482/44
1,725,494 A * 8/1929 Varnum ..... A63D 15/005 473/40
3,992,005 A * 11/1976 Richey ..... A63D 15/005 473/40
D480,775 S * 10/2003 Fischer ..... A63D 15/005 D21/782
8,496,535 B2 * 7/2013 Kaplan ..... A63D 15/005 473/41
9,132,339 B1 * 9/2015 Smith ..... A63D 15/005 473/40
9,616,319 B2 * 4/2017 Geiges ..... A63D 15/005 473/40
9,737,790 B2 * 8/2017 Ross ..... A63D 15/005 473/40
2013/0040748 A1 * 2/2013 Byrne ..... A63D 15/005 473/40
2016/0001168 A1 * 1/2016 Kincaid ..... A63D 15/005 473/40

* cited by examiner

*Primary Examiner* — Mitra Aryanpour
(74) *Attorney, Agent, or Firm* — Edward R. Ergenzinger

(57) ABSTRACT

A billiard ball rack for racking 3 or more billiard balls is provided, comprising a base arm and two side arms configured to enable the billiard ball rack to be foldable and self-aligning. The inner surfaces of the base arms and the side arms are tapered at an angle relative to a top surface of the billiard ball rack, and the arms are pivotally connected to one another and configured such that when the billiard rack is positioned around a set of billiard balls and downward pressure is applied, the base arm and side arms of the billiard rack automatically adjust to form an equilateral triangle. The billiard ball rack is also configured to be folded compactly to fit within standard pool cue cases while the arms remain interconnected. Methods of using the billiard ball rack for racking billiard balls are also provided.

17 Claims, 7 Drawing Sheets

FOLDABLE SELF-ALIGNING BILLIARD BALL RACK

FIELD OF THE INVENTION

The presently disclosed subject matter relates generally to a billiard ball rack and more particularly to a foldable self-aligning billiard ball rack suitable for arranging billiard balls on a table.

BACKGROUND

Racks for positioning billiard balls on a pool or billiard table typically include fixed sides, and therefore, are bulky and difficult to store and carry from place to place. This presents a challenge for some pool and billiard players, specifically, for serious pool and billiard players who like to use their own personal rack when competing in tournaments and other competitions. The size of a conventional three-sided billiard ball rack requires a considerable amount of room in a cue case, necessitating a cue case that is oversized and bulky. Furthermore, billiard ball racks that are designed to be foldable fail to provide the same level of support when arranging billiard balls as racks with fixed sides.

Accordingly, there is a need for billiard ball rack that can be easily stored and transported but that also provides adequate support for arranging billiard balls.

SUMMARY

To address the foregoing problems, in whole or in part, and/or other problems that may have been observed by persons skilled in the art, the present disclosure provides compositions and methods as described by way of example as set forth below.

A foldable self-aligning billiard ball rack is provided, comprising:

a) a base arm, comprising a first base end portion and a second base end portion, wherein the first base end portion defines a first pivot portion and a first through hole, wherein the second base end portion defines a second pivot portion and a second through hole, and further wherein the first base end portion and the second base end portion each define steps along an inner surface of the base arm adapted to contact billiard balls; and b) two side arms, wherein each side arm comprises a first side end portion and a second side end portion, wherein the first end portion defines a first elongated hole and a hinge structure configured to enable the pivotal coupling of the first side end portion with the first base end portion;

whereby the billiard ball rack is configured to be foldable and self-aligning. In some embodiments, the hinge structure comprises a chain link comprising at least two link plates and at least two pins extending between the link plates and connecting the link plates together. In other embodiments, the at least two link plates are arranged spaced apart and substantially parallel to each other, and wherein the pins are arranged at two longitudinal ends of the link plates and extend in a lateral direction relative to longitudinal extensions of the link plates.

In other embodiments, the pins comprise a first pin and a second pin, wherein:

i) the first pin is configured to couple the hinge structure with the base arm and extend through the first through hole, and wherein the hinge structure and the base arm are configured to pivot relative to each other about a central longitudinal axis of the first pin; and ii) the second pin is configured to couple the hinge structure with one of the side arms and extend through the first elongated hole of the side arm, and wherein the hinge structure and the side arm are configured to pivot relative to each other about a central longitudinal axis of the second pin.

In some embodiments, the hinge structure and the base arm are configured to pivot relative to each other about a central longitudinal axis of the first pin, and wherein the hinge structure and the side arm are configured to pivot relative to each other about a central longitudinal axis of the second pin.

In other embodiments, the billiard ball rack further comprises a third hinge structure pivotally coupled to the second end portion of one of the side arms, wherein the third hinge structure comprises a third pin configured to extend through the second elongated hole, and wherein the third hinge structure and the side arm are adapted to pivot relative to a central longitudinal axis of the third pin. In some embodiments, the side arm is configured to be removably coupled to the third hinge structure. In other embodiments, the second end portion of the side arm comprises a hook structure.

In other embodiments, the second end portion defines a step along an inner surface of the side arm adapted to contact billiard balls.

In further embodiments, the billiard ball rack is configured to be folded such that the base arm and the two side arms are arranged in a side-by-side arrangement while remaining interconnected, wherein the base arm abuts the two side arms, and wherein the folded billiard ball rack measures less than 15" in length, 3" in height, and 1" in width.

In another embodiment, the billiard ball rack is configured such that the base arm and the side arms may be assembled into a substantially triangular configuration whereby the base arm and the side arms define a triangular shaped space therebetween for receiving billiard balls.

In another embodiment, the billiard ball rack is configured such that when the billiard rack is positioned with a set of billiard balls in the triangular shaped space and downward pressure is applied equally to the base arm and the side arms, the base arm and side arms of the billiard rack automatically adjust such that an angle subtended between any two adjacent arms of the base arm and the side arms is approximately 60 degrees.

In further embodiments, the inner surfaces of the side arms and the inner surface of the base arm are tapered at an angle relative to a top surface of the billiard ball rack, particularly wherein the angle of the taper ranges from 10 degrees to 90 degrees, and more particularly wherein the angle of the taper is about 62 degrees. In other embodiments, the inner surfaces of the side arms and the inner surface of the base arm comprise a planar, curved, cammed, concave, or convex surface, wherein the planar, curved, cammed, concave, or convex surface comprises paint, polytetrafluoroethylene (PTFE), neoprene, plastic, or is bare.

In other embodiments, the base arm and side arms are configured to enable the racking of at least 3, 6, 10, or 15 billiard balls.

A method of racking billiard balls is also provided using any embodiment of billiard ball rack described herein, comprising:

aa) unfolding the billiard ball rack from a compact storage position, and wherein the side arms comprise a first side arm and a second side arm;

bb) connecting the first side arm to the second side arm by coupling the second side arm with the third hinge structure, whereby the second pin of the third hinge structure is inserted inside a groove in the hook structure of the second side arm;

cc) shaping the billiard ball rack into the approximate shape of an equilateral triangle;

dd) aligning and positioning the billiard balls in close proximity to one another on the table in a substantially triangular shape;

ee) positioning the billiard ball rack on top of the billiard balls and pressing down equally on the base arm and side arms, whereby the billiard ball rack automatically adjusts to form the shape of an equilateral triangle;

ff) positioning the billiard ball rack and the billiard balls at a desired location;

gg) pressing down equally on the base arm and side arms, thereby racking the billiard balls into a triangular shape; and hh) removing the billiard ball rack from the billiard balls, whereby the billiard ball rack is lifted vertically while being kept level.

Additional features of the invention will be or will become apparent to one with skill in the art upon examination of the following figures and detailed description. It is intended that all such additional features and advantages be included within this description, be within the scope of the invention, and be protected by the accompanying claims.

BRIEF DESCRIPTION OF THE DRAWINGS

Figure 1:
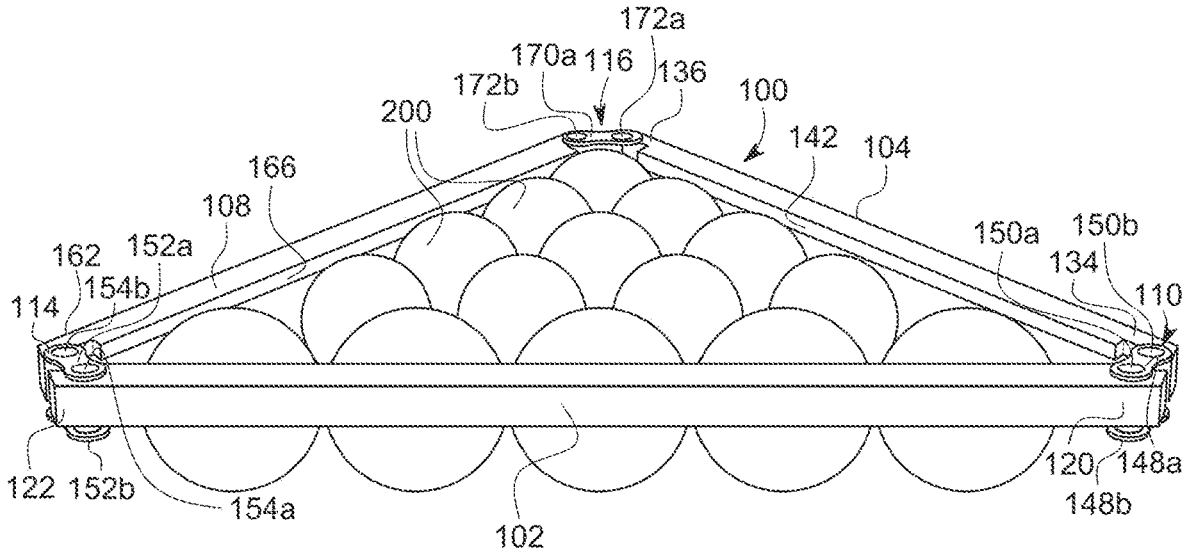
Figure 2:
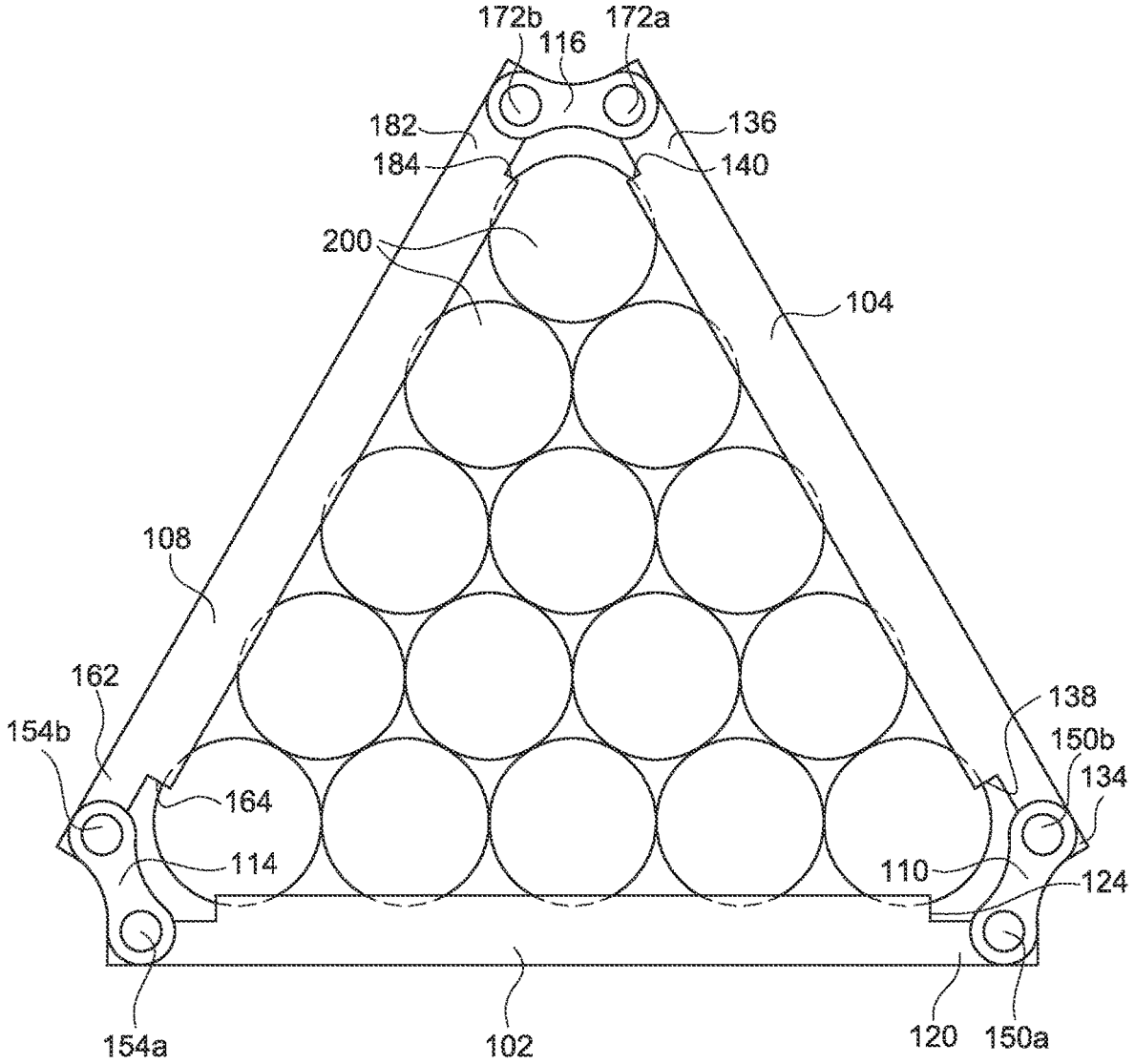
Figure 3:
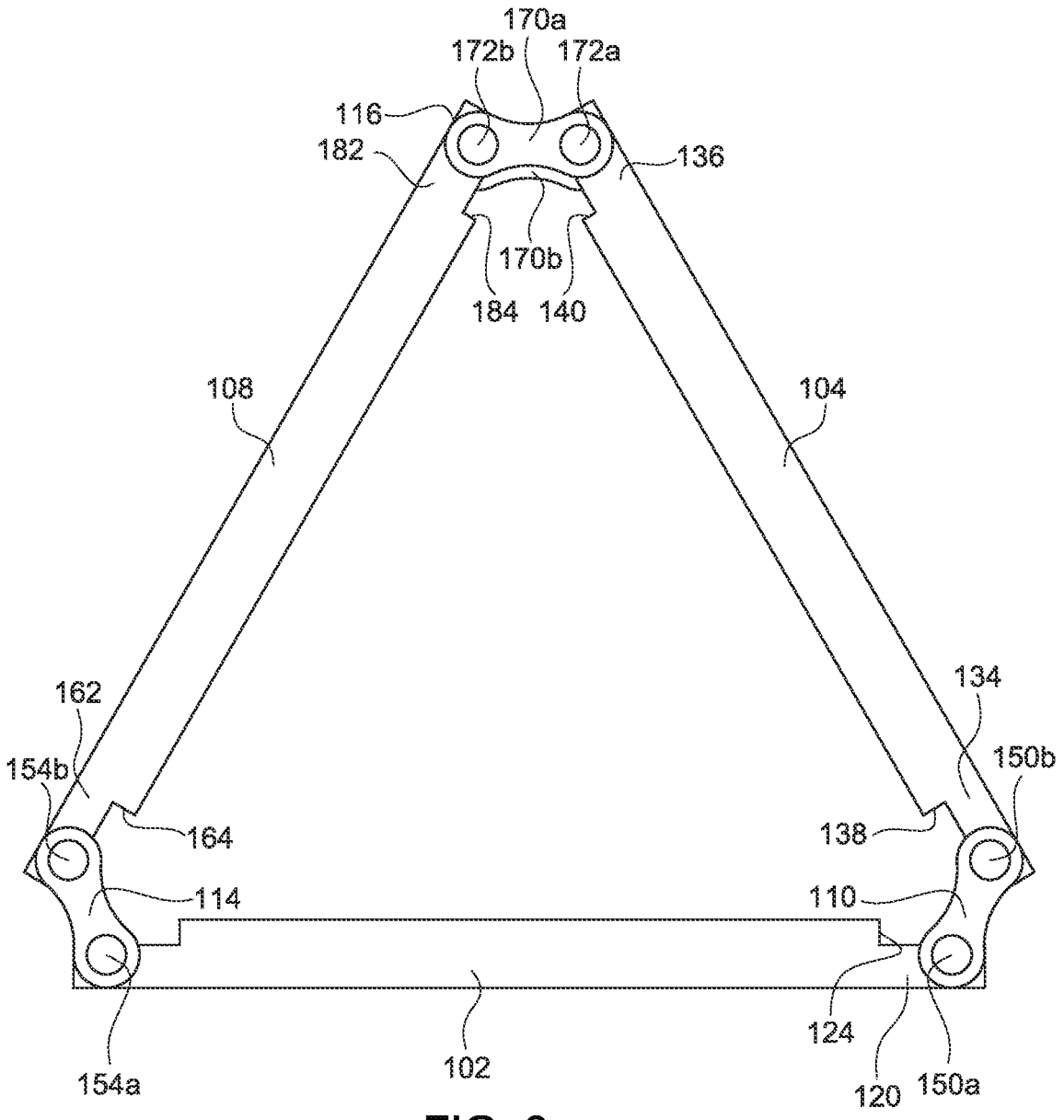
Figure 4:
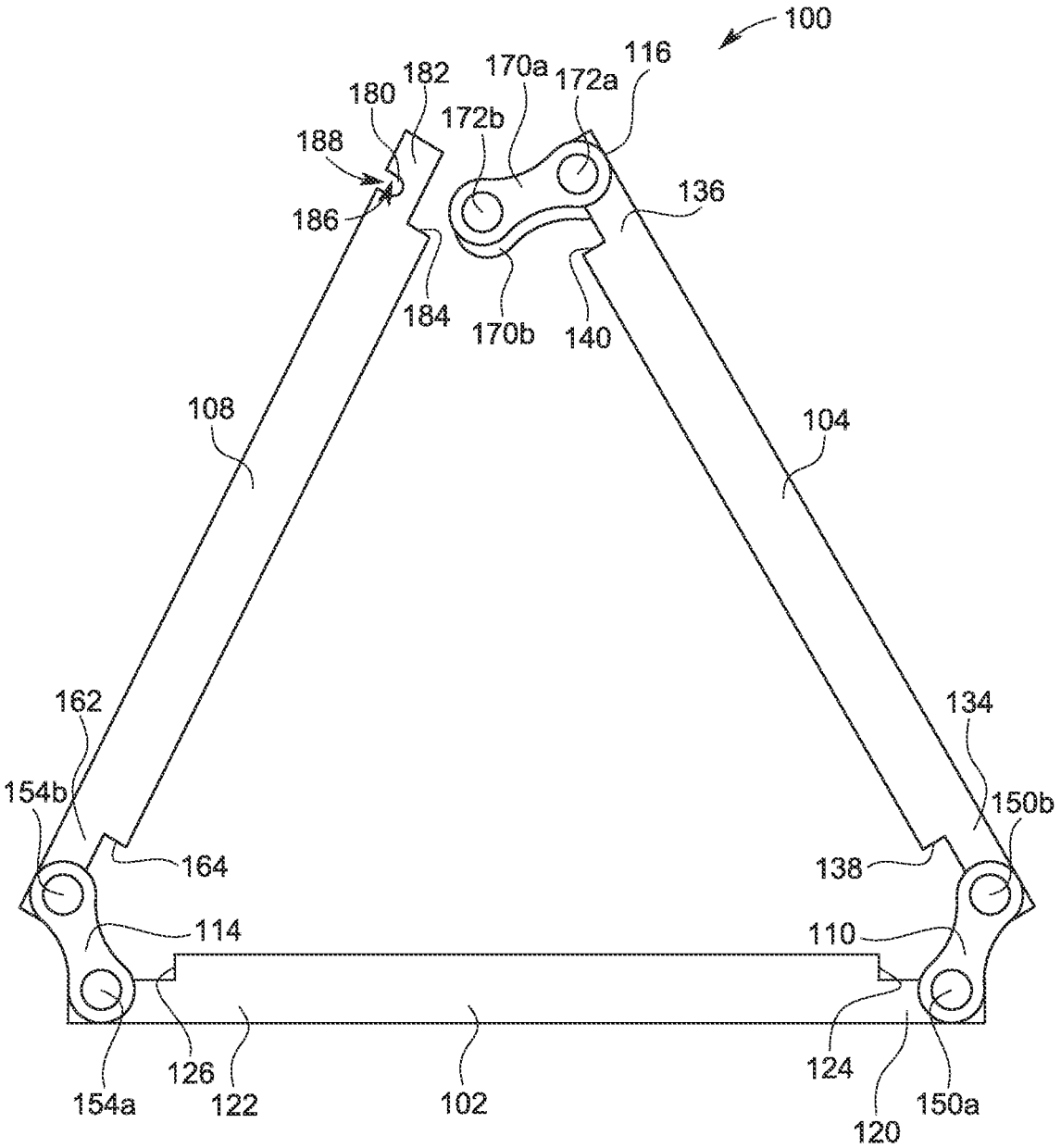
Figure 5:
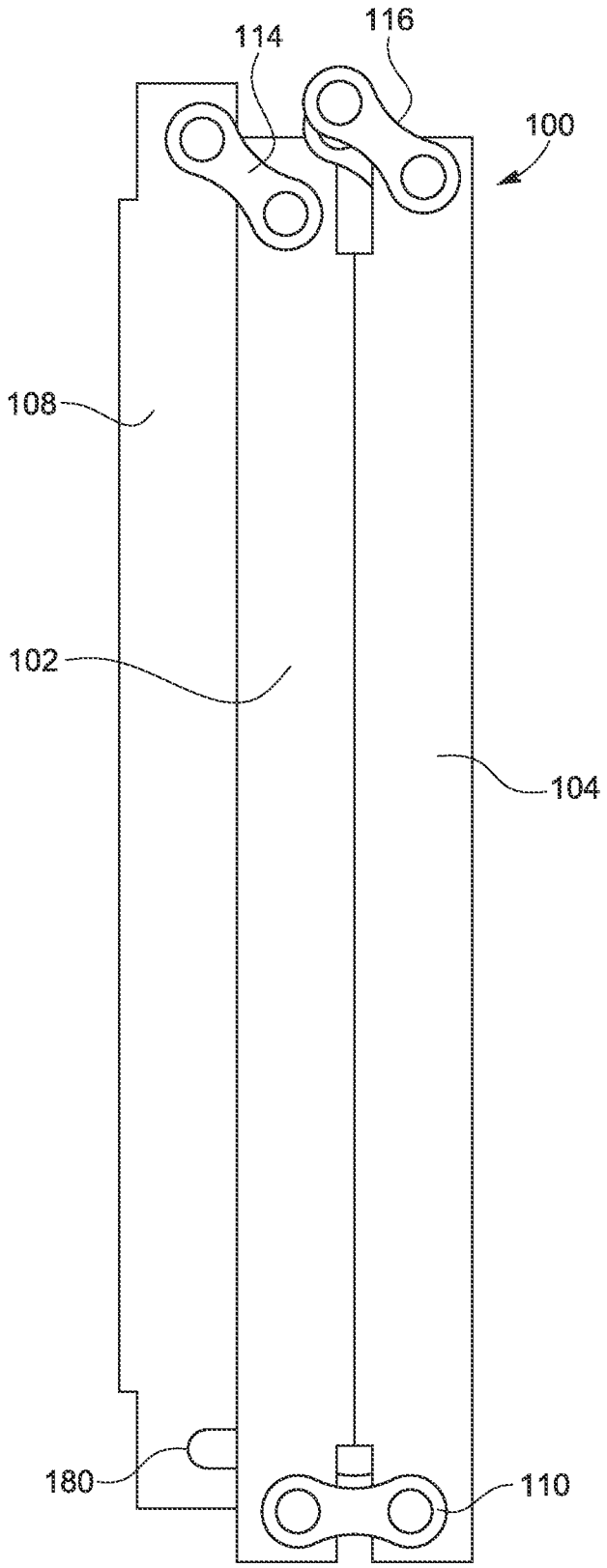
Figure 6:
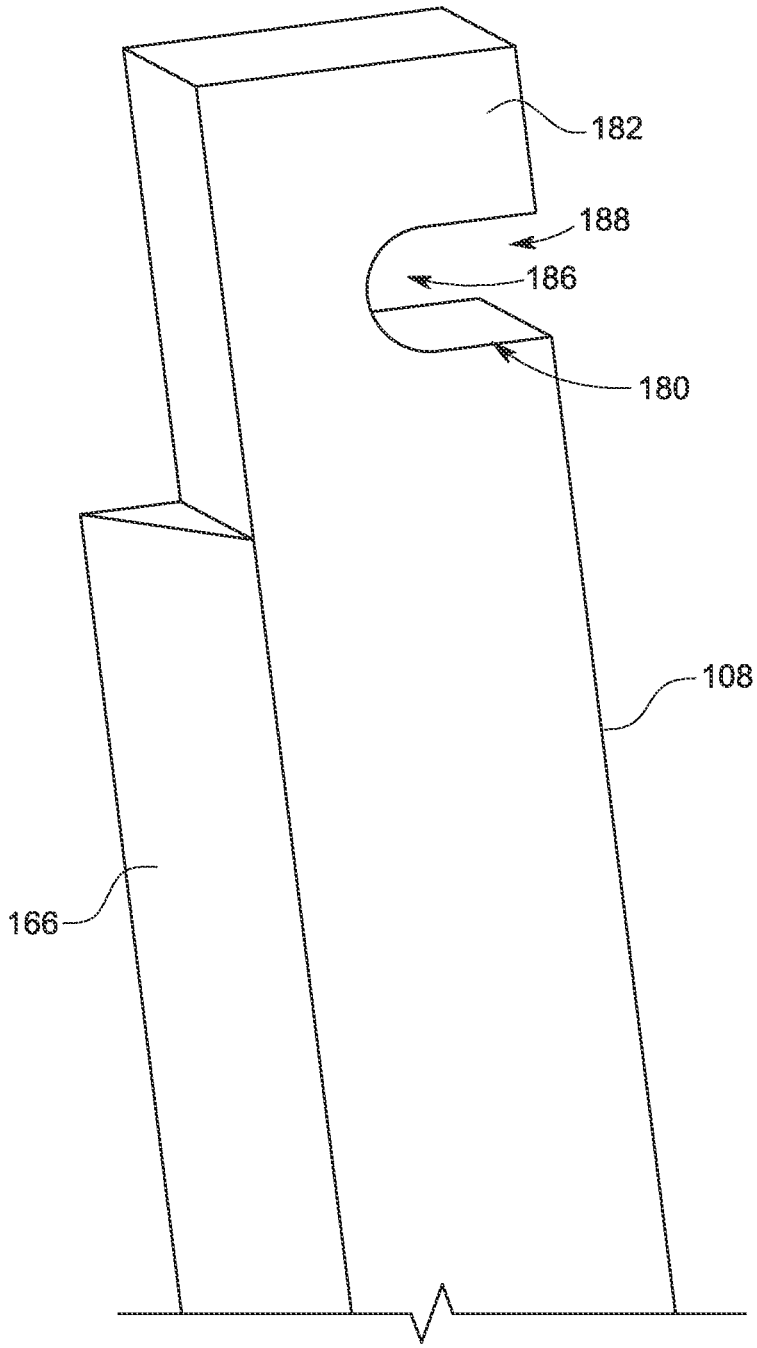
Figure 7:
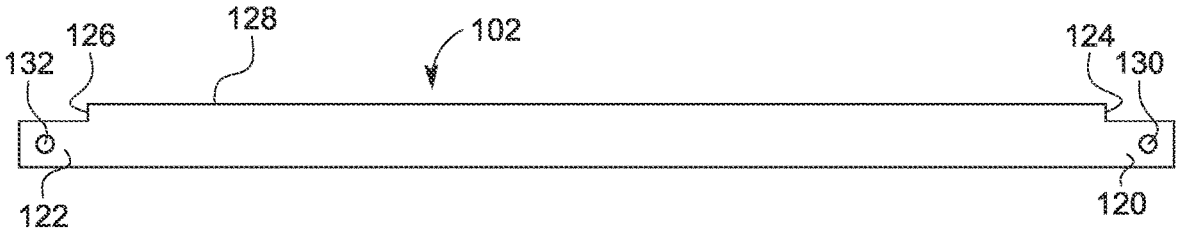
Figure 8:
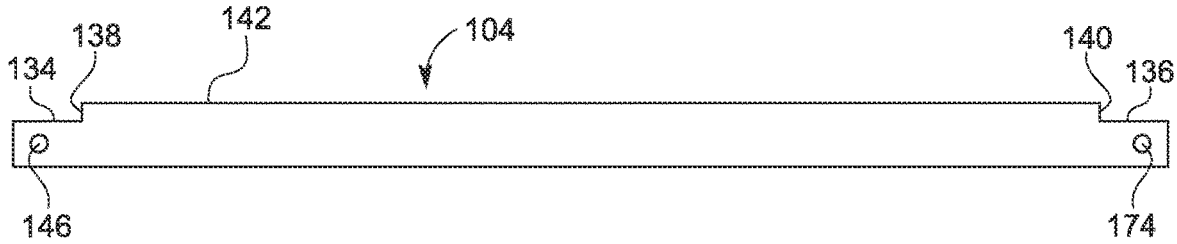
Figure 9:
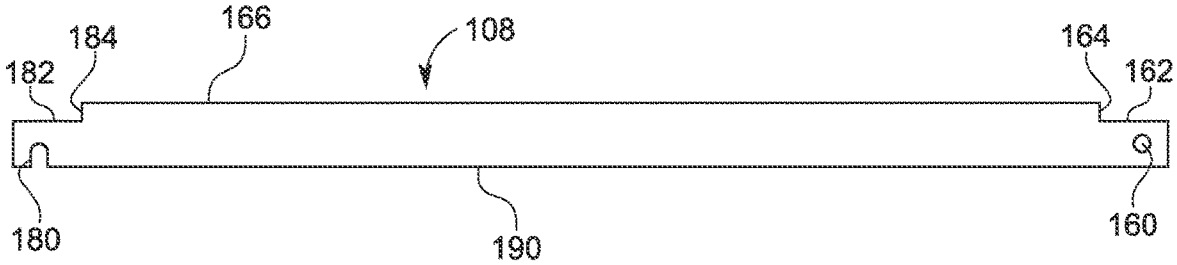
Figure 10:
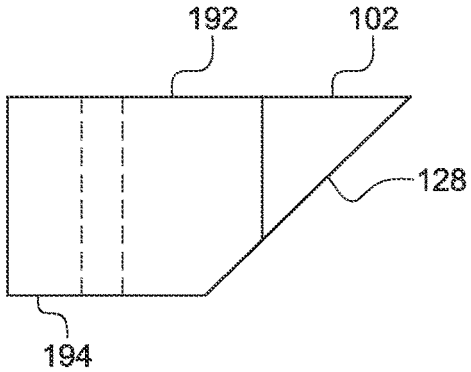

Having thus described the subject matter of the present invention in general terms, reference will now be made to the accompanying drawings, which are not necessarily drawn to scale, and wherein:

FIG. 1 illustrates a top perspective of a billiard ball rack with a plurality of billiard balls arranged with the billiard ball rack;

FIG. 2 illustrates a top view of the billiard ball rack along with the plurality of billiard balls arranged inside the billiard balls;

FIG. 3 illustrates a top view of the billiard ball rack in a racking position;

FIG. 4 illustrates a top perspective view of the billiard ball rack with a second side arm disengaged from a third hinge structure of the billiard ball rack;

FIG. 5 illustrates the billiard ball rack arranged in a compact storage position;

FIG. 6 illustrates an enlarged back-side view of a portion of the second side arm of the billiard ball rack depicting a hook structure of the second side arm;

FIG. 7 illustrates a top view of a base arm of the billiard ball rack depicting various structural features of the base arm;

FIG. 8 illustrates a top view of a first side arm of the billiard ball rack depicting various structural features of the first side arm;

FIG. 9 illustrates a top view of the second side arm of the billiard ball rack depicting various structural features of the second side arm; and FIG. 10 illustrates a side view of the base arm and is also applicable to side one and side two. It depicts an inner surface of the base arm arranged at an inclination relative to a top surface of the base arm.

DETAILED DESCRIPTION

The subject matter of the present invention now will be described more fully hereinafter with reference to the accompanying drawings, in which some, but not all embodiments of the subject matter of the present invention are shown. Like numbers refer to like elements throughout. The subject matter of the present invention may be embodied in many different forms and should not be construed as limited to the embodiments set forth herein; rather, these embodiments are provided so that this disclosure will satisfy applicable legal requirements. Indeed, many modifications and other embodiments of the subject matter of the present invention set forth herein will come to mind to one skilled in the art to which the subject matter of the present invention pertains having the benefit of the teachings presented in the foregoing descriptions and the associated drawings. All illustrations of the drawings are for the purpose of describing selected versions of the present invention and are not intended to limit the scope of the present invention. Therefore, it is to be understood that the subject matter of the present invention is not to be limited to the specific embodiments disclosed and that modifications and other embodiments are intended to be included within the scope of the appended claims.

Foldable Self-Aligning Billiard Ball Rack

The presently disclosed invention relates to a foldable self-aligning billiard ball rack, comprising:

a) a base arm, comprising a first base end portion and a second base end portion, wherein the first base end portion defines a first pivot portion and a first through hole, wherein the second base end portion defines a second pivot portion and a second through hole, and further wherein the first base end portion and the second base end portion each define steps along an inner surface of the base arm adapted to contact billiard balls; and b) two side arms, wherein each side arm comprises a first side end portion and a second side end portion, wherein the first end portion defines a first elongated hole and a hinge structure configured to enable the pivotal coupling of the first side end portion with the first base end portion;

whereby the billiard ball rack is configured to be foldable and self-aligning. In some embodiments, the hinge structure comprises a chain link comprising at least two link plates and at least two pins extending between the link plates and connecting the link plates together. In other embodiments, the at least two link plates are arranged spaced apart and substantially parallel to each other, and wherein the pins are arranged at two longitudinal ends of the link plates and extend in a lateral direction relative to longitudinal extensions of the link plates.

In other embodiments, the pins comprise a first pin and a second pin, wherein:

i) the first pin is configured to couple the hinge structure with the base arm and extend through the first through hole, and wherein the hinge structure and the base arm are configured to pivot relative to each other about a central longitudinal axis of the first pin; and ii) the second pin is configured to couple the hinge structure with one of the side arms and extend through the first elongated hole of the side arm, and wherein the hinge structure and the side arm are configured to pivot relative to each other about a central longitudinal axis of the second pin.

In some embodiments, the hinge structure and the base arm are configured to pivot relative to each other about a central longitudinal axis of the first pin, and wherein the hinge structure and the side arm are configured to pivot relative to each other about a central longitudinal axis of the second pin.

In other embodiments, the billiard ball rack further comprises a third hinge structure pivotally coupled to the second end portion of one of the side arms, wherein the third hinge structure comprises a third pin configured to extend through the second elongated hole, and wherein the third hinge structure and the side arm are adapted to pivot relative to a central longitudinal axis of the third pin. In some embodiments, the side arm is configured to be removably coupled to the third hinge structure. In other embodiments, the second end portion of the side arm comprises a hook structure.

In other embodiments, the second end portion defines a step along an inner surface of the side arm adapted to contact billiard balls.

In further embodiments, the billiard ball rack is configured to be folded such that the base arm and the two side arms are arranged in a side-by-side arrangement while remaining interconnected, wherein the base arm abuts the two side arms, and wherein the folded billiard ball rack measures less than 15" in length, 3" in height, and 1" in width.

In another embodiment, the billiard ball rack is configured such that the base arm and the side arms may be assembled into a substantially triangular configuration whereby the base arm and the side arms define a triangular shaped space therebetween for receiving billiard balls.

In another embodiment, the billiard ball rack is configured such that when the billiard rack is positioned with a set of billiard balls in the triangular shaped space and downward pressure is applied equally to the base arm and the side arms, the base arm and side arms of the billiard rack automatically adjust such that an angle subtended between any two adjacent arms of the base arm and the side arms is about or exactly 60 degrees.

Referring now to FIGS. 1 and 2, a billiard ball rack 100 (hereinafter referred to as rack 100) arranged around and enclosing a plurality of billiard balls 200 on a billiard table or a pool table is shown. As shown in FIGS. 1 to 5, the rack 100 includes a base arm 102 and a pair of side arms, for example, a first side arm 104 and a second side arm 108, each pivotally coupled to the base arm 102. Additionally, the rack 100 includes a first hinge structure 110 pivotally coupling the first side arm 104 and the base arm 102 and a second hinge structure 114 pivotally coupling the base arm 102 and the second side arm 108. As shown in FIGS. 1 to 5 and 7, the base arm 102 includes a first end portion 120 defining a first pivot portion and a second end portion 122 defining a second pivot portion. As shown, the first end portion 120 and the second end portion 122 defines steps 124, 126 along an inner surface 128 of the base arm 102 adapted to contact the billiard balls 200. The first end portion 120 defines a first through hole 130 (best shown in FIG. 7) to enable the pivotal coupling of the base arm 102 with the first side arm 104. Similarly, the second end portion 122 defines a second through hole 132 (best shown in FIG. 7) to facilitate the pivotal coupling of the second side arm 108 and the base arm 102.

Similar to the base arm 102, the first side arm 104 includes a first end portion 134 defining a first pivot structure of the first side arm 104 and a second end portion 136 defining a second pivot structure of the first side arm 104. As shown, the first end portion 134 and the second end portion 136 defines steps 138, 140 along an inner surface 142 of the first side arm 104 adapted to contact the billiard balls 200. In the illustrated embodiment, the base arm 102 and the first side arm 104 are identical in structure and construction, and the first end portion 134 is pivotally coupled to the first end portion 120 of the first side arm 104 via the first hinge structure 110. The first end portion 134 of the first side arm 104 defines a first elongated hole 146 (best shown in FIG. 8) to facilitate the pivotal coupling of the first end portion 134 of the first side arm 104 with the first hinge structure 110. As shown in FIGS. 1 to 5, the first hinge structure 110 is contemplated as a chain link having two link plates 148*a*, 148*b* and two pins 150*a*, 150*b* (i.e., rollers) extending between the link plates 148*a*, 148*b* and connecting the link plates 148*a*, 148*b* together. As shown, the link plates 148*a*, 148*b* are arranged spaced apart and substantially parallel to each other and the pins 150*a*, 150*b* are arranged at the two longitudinal ends of the link plates 148*a*, 148*b*. Pins 150*a*, 150*b* extend in a lateral direction relative to the longitudinal extension of the link plates 148*a*, 148*b*. As shown, a first pin 150*a* of the two pins 150*a*, 150*b* couples the first hinge structure 110 with the base arm 102 and extends through the first through hole 130, while a second pin 150*b* of the two pins 150*a*, 150*b* couples the first hinge structure 110 with the first side arm 104 and extends through the first elongated hole 146. It may be appreciated that the first hinge structure 110 and the base arm 102 are pivotally coupled to each other and may pivot relative to each other about a central longitudinal axis of the first pin 150*a*. Similarly, the first hinge structure 110 and the first side arm 104 are pivotally coupled to each other and may pivot relative to each other about a central longitudinal axis of the second pin 150*b*.

Similar to the first hinge structure 110, the second hinge structure 114 includes two link plates 152*a*, 152*b* and two pins 154*a*, 154*b* and is coupled to the second end portion 122 of the base arm 102 and a first end portion 162 of the second side arm 108. The second hinge structure 114 is identical to the first hinge structure 110, and a first pin 154*a* of the two pins 154*a*, 154*b* extends through the second through hole 132 of the base arm 102 to pivotally engage the second hinge structure 114 with the base arm 102. The base arm 102 and the second hinge structure 114 may pivot relative to each other about a central longitudinal axis of the first pin 154*a*. To pivotally engage the second hinge structure 114 with the second side arm 108, a second pin 154*b* of the two pins 154*a*, 154*b* extends through an elongated hole 160 (shown in FIG. 9) defined at the first end portion 162 of the second side arm 108. The second hinge structure 114 and the second side arm 108 is adapted to pivot about a central longitudinal axis of the second pin 154*b*. The first end portion 162 defines a step 164 at an inner surface 166 of the second side arm 108. Although the first hinge structure 110 and the second hinge structure 114 are shown and contemplated as double hinge joints (e.g., A2040 links), it may be appreciated that the first hinge structure 110 and the second hinge structure 114 may include chain links having triple hinge joints or any other suitable structure known in the art and suitable to pivotally couple the base arm 102 to the side arms 104, 108. In some embodiments, the base arm 102 and the side arms 104, 108 may include fork and eye structures at the ends of the base arm 102 and the side arms 104, 108 to enable the pivotal coupling of the base arm 102 and the side arms 104, 108. Fork and eye structures are engaged together via pins as known in the art.

Additionally, the rack 100 includes a third hinge structure 116 identical to the first hinge structure 110 and is pivotally coupled to the second end portion 136 of the first side arm 104. As with the first hinge structure 110, the third hinge structure 116 includes two link plates 170*a*, 170*b* and two pins 172*a*, 172*b* joining the two link plates 170*a*, 170*b* together. To enable the pivotal coupling of the first side arm 104 with the third hinge structure 116, a first pin 172*a* of the two pins 172*a*, 172*b* of the third hinge structure 116 extends through a second elongated hole 174 (best shown in FIG. 8) defined at the second end portion 136 of the first side arm 104. The first side arm 104 and the third hinge structure 116 is adapted to pivot relative to a central longitudinal axis of the first pin 172*a*.

Moreover, the second side arm 108 is removably coupled to the third hinge structure 116, and hence the first side arm 104. To facilitate the removable coupling of the second side arm 108 with the third hinge structure 116 (i.e., a second pin 172*b* of the two pins 172*a*, 172*b* of the third hinge structure 116), the second side arm 108 includes a hook structure 180 (best shown in FIG. 6) defined at a second end portion 182 of the second side arm 108. Similar to the first end portion 162 of the second side arm 108, the second end portion 182 defines a step 184 along the inner surface 166 of the second side arm 108. The inner surface 166 is adapted to contact outer edges of the ball 200 when arranged inside the rack 100. As best shown in FIG. 6, the hook structure 180 includes a through groove 186 extending laterally to the second arm 108 and an opening 188 extending from an outer surface 190 of the second side arm 108 to the groove 186. The groove 186 and the opening 188 are arranged such that a central longitudinal axis of the groove 186 and a central longitudinal axis of the opening 188 are arranged substantially perpendicularly to each other. The removable coupling of the second side arm 108 with the first side arm 104 enables a movement of the rack into a substantially triangular racking position and a compact storage position. In the compact storage position, as shown in FIG. 5, the hook structure 180 is disposed disengaged from the third hinge structure 116 (i.e., the second pin 172*b*) and the three arms 102, 104, 108 are arranged in a compact side-by-side arrangement. As shown in FIG. 5, in the compact storage position, the base arm 102 is arranged between the two side arms 104, 108 and is abutted with the two side arms 104, 108. In an embodiment, in the compact storage position, the individual parts remain interconnected to a size measuring less than 15"×3"×1" at its widest points to enable a positioning or storage of the rack 100 in the side pocket of many pool cue cases, thereby enabling an easy transportation of the rack 100.

In the racking position, as shown in FIGS. 1 to 3, the hook structure 180 is engaged with the second pin 172*b* of the third hinge structure 116 such that the second pin 172*b* is arranged inside the groove 186. It may be appreciated that the second pin 172*b* enters the groove 186 through the opening 188. In an embodiment, a width 'w' of the opening is substantially equal to a diameter of the second pin 172*b*. As shown in FIGS. 1 to 3, in the racking position, the three arms 102, 104, 108 are arranged in substantially triangular configuration with the three arms 102, 104, 108 forming three sides of a triangle defining a triangular shaped space therebetween for receiving the balls 202. Accordingly, in the racking position, an angle subtended between any two adjacent arms of the three arms is approximately 60 degrees.

In further embodiments, the inner surfaces of the side arms and the inner surface of the base arm are tapered at an angle relative to a top surface of the billiard ball rack, particularly wherein the angle of the taper ranges from about or exactly 10 degrees to about or exactly 90 degrees, and more particularly wherein the angle of the taper is about or exactly 62 degrees. In other embodiments, the inner surfaces of the side arms and the inner surface of the base arm comprise a planar, curved, cammed, concave, or convex surface, wherein the planar, curved, cammed, concave, or convex surface comprises paint, polytetrafluoroethylene (PTFE), neoprene, plastic, or is bare.

Accordingly, to enable smooth positioning of the rack 100 around the billiard balls 200 in the racking position, inner surfaces 128, 142, 166 of each of the arms 102, 104, 108 that contacts the billiard balls 202 are tapered. For example, the inner surface 128 of the base arm 102, as shown in FIG. 10, extends obliquely and rearwardly from a top surface 192 of the base arm 102 to a bottom surface 194 of the base arm 102. In an embodiment, the inner surfaces 128, 142, 166 extend at 62 degrees inclination. However, it may be appreciated the inclination of each of inner surfaces 128, 142, 166 may vary between 10 degrees to 90 degrees. It may be appreciated that each of the inner surfaces 128, 142, 166 may be a planner surface, a curved surface, a cammed surface, a concave surface, or a convex surface. Also, although the arms 102, 104, 108 having four surfaces are shown and contemplated, it can be envisioned that the arms 102, 104, 108 may include any other cross-section, such as, but not limited to, triangular, circular, pentagon, elliptical, trapezoidal, or any other suitable cross-section known in the art. In some embodiments, the inner surfaces 128, 142, 166 may be covered with a material to facilitate the alignment of the balls 200 and removal of the rack 100. Such materials include but are not limited to paint, polytetrafluoroethylene (PTFE; commonly known by brand name of Teflon®), neoprene, and plastic.

Also, although the rack 100 is shown for arranging 8 balls, it may be appreciated the lengths of the arms 102, 104, 108 can be suitably selected for use with any number of balls 200, for example 3, 6, 10, 15 or more balls.

A method of racking billiard balls is also provided using any embodiment of billiard ball rack described herein, comprising:

aa) unfolding the billiard ball rack from a compact storage position, and wherein the side arms comprise a first side arm and a second side arm;

bb) connecting the first side arm to the second side arm by coupling the second side arm with the third hinge structure, whereby the second pin of the third hinge structure is inserted inside a groove in the hook structure of the second side arm;

cc) shaping the billiard ball rack into the approximate shape of an equilateral triangle;

dd) aligning and positioning the billiard balls in close proximity to one another on the table in a substantially triangular shape;

ee) positioning the billiard ball rack on top of the billiard balls and pressing down equally on the base arm and side arms, whereby the billiard ball rack automatically adjusts to form the shape of an equilateral triangle;

ff) positioning the billiard ball rack and the billiard balls at a desired location;

gg) pressing down equally on the base arm and side arms, thereby racking the billiard balls into a triangular shape; and hh) removing the billiard ball rack from the billiard balls, whereby the billiard ball rack is lifted vertically while being kept level.

Accordingly, to use the rack 100 for racking or arranging the balls 200 on a billiard table, a user may unfold the rack 100 from the compact storage position (i.e., folded position), and connects the first side arm 104 to the second side arm 108, by coupling the second side arm 108 with the third hinge structure 116. For so doing, the user may insert the second pin 172*b* of the third hinge structure 116 inside the groove 186 of the hook structure 180 of the second side arm 108. Subsequently, the user may shape the rack 100 into an approximate equilateral triangle. Further, the user aligns and positions the balls 200 together on the table in a substantially triangular shape in close proximity to each other. Thereafter, the user may position the rack 100 on top of the balls 200 and presses down the rack 100 gently to arrange the rack 100 into an equilateral triangle shape. When surrounding the outer edges of the billiard balls 200, the rack 100 will automatically adjust to an equilateral triangle forming 60 degrees angles at its vertices when pressure is applied equally to the top of all three arms 102, 104, 108 of the rack 100 when the rack is positioned on top the billiard balls 200.

Further, the user may then slide the rack 100 with balls 200 positioned underneath the rack 100 to the desired position on the table. After positioning the balls 200 and the rack 100 at the desired position, the user may apply pressure on all the arms 102, 104, 108 simultaneously to press the rack 100 downwardly. As the downward pressure is applied to all three arms 102, 104, 108 of the rack 100 simultaneously, the billiard balls 200 are forced together and the outer-edge balls 200 are forced downward. In this manner, the rack 100 will align the balls 200 in the close formation. Also, the downward force on the balls 200 helps keep the balls 200 in position when the rack 100 is removed. Moreover, as the inner surfaces 128, 142, 166 of the arms 102, 104, 108 are inclined, the rack 100 is able to move downwardly in a smooth manner, keeping the balls 200 together.

General Definitions

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount, or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the subject matter of the present invention. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

All publications, patent applications, patents, and other references mentioned in the specification are indicative of the level of those skilled in the art to which the presently disclosed subject matter pertains. All publications, patent applications, patents, and other references are herein incorporated by reference to the same extent as if each individual publication, patent application, patent, and other reference was specifically and individually indicated to be incorporated by reference. It will be understood that, although a number of patent applications, patents, and other references are referred to herein, such reference does not constitute an admission that any of these documents forms part of the common general knowledge in the art.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A foldable self-aligning billiard ball rack, comprising:

a) a base arm, comprising a first base end portion and a second base end portion, wherein the first base end portion defines a first pivot portion and a first through hole, wherein the second base end portion defines a second pivot portion and a second through hole, and further wherein the first base end portion and the second base end portion each define steps along an inner surface of the base arm adapted to contact billiard balls; and b) two side arms, wherein each side arm comprises a first side end portion and a second side end portion, wherein the first end portion defines a first elongated hole and a hinge structure configured to enable the pivotal coupling of the first side end portion with the first base end portion;

whereby the billiard ball rack is configured to be self-aligning and foldable such that the base arm and the two side arms are arranged in a side-by-side arrangement while remaining interconnected, and wherein the inner surfaces of the side arms and the inner surface of the base arm are tapered at an angle relative to a top surface of the billiard ball rack.

2. The billiard ball rack of claim 1, wherein the hinge structure comprises a chain link comprising at least two link plates and at least two pins extending between the link plates and connecting the link plates together.

3. The billiard ball rack of claim 2, wherein the at least two link plates are arranged spaced apart and substantially parallel to each other, and wherein the pins are arranged at two longitudinal ends of the link plates and extend in a lateral direction relative to longitudinal extensions of the link plates.

4. The billiard ball rack of claim 3, wherein the pins comprise a first pin and a second pin, wherein:

i) the first pin is configured to couple the hinge structure with the base arm and extend through the first through hole, and wherein the hinge structure and the base arm are configured to pivot relative to each other about a central longitudinal axis of the first pin; and ii) the second pin is configured to couple the hinge structure with one of the side arms and extend through the first elongated hole of the side arm, and wherein the hinge structure and the side arm are configured to pivot relative to each other about a central longitudinal axis of the second pin.

5. The billiard ball rack of claim 4, wherein the hinge structure and the base arm are configured to pivot relative to each other about a central longitudinal axis of the first pin, and wherein the hinge structure and the side arm are configured to pivot relative to each other about a central longitudinal axis of the second pin.

6. The billiard ball rack of claim 5, further comprising a third hinge structure pivotally coupled to the second end portion of one of the side arms, wherein the third hinge structure comprises a third pin configured to extend through the second elongated hole, and wherein the third hinge structure and the side arm are adapted to pivot relative to a central longitudinal axis of the third pin.

7. The billiard ball rack of claim 6, wherein the side arm is configured to be removably coupled to the third hinge structure.

8. The billiard ball rack of claim 7, wherein the second end portion of the side arm comprises a hook structure.

9. The billiard ball rack of claim 8, wherein the second end portion defines a step along an inner surface of the side arm adapted to contact billiard balls.

10. The billiard ball rack of claim 9, wherein the base arm abuts the two side arms, and wherein the folded billiard ball rack measures less than 15" in length, 3" in height, and 1" in width.

11. The billiard ball rack of claim 10, wherein the billiard ball rack is configured such that the base arm and the side arms may be assembled into a substantially triangular configuration whereby the base arm and the side arms define a triangular shaped space therebetween for receiving billiard balls.

12. The billiard ball rack of claim 11, wherein the billiard ball rack is configured such that when the billiard rack is positioned with a set of billiard balls in the triangular shaped space and downward pressure is applied equally to the base arm and the side arms, the base at iii and side arms of the billiard rack automatically adjust such that an angle subtended between any two adjacent arms of the base arm and the side arms is approximately 60 degrees.

13. The billiard ball rack of claim 12, wherein the angle of the taper ranges from 10 degrees to 90 degrees.

14. The billiard ball rack of claim 13, wherein the angle of the taper is about 62 degrees.

15. The billiard ball rack of claim 12, wherein the inner surfaces of the side arms and the inner surface of the base arm comprise a planar, curved, cammed, concave, or convex surface, wherein the planar, curved, cammed, concave, or convex surface comprises paint, polytetrafluoroethylene (PTFE), neoprene, plastic, or is bare.

16. The billiard ball rack of claim 12, wherein the base arm and side arms are configured to enable the racking of at least 3, 6, 10 or 15 billiard balls.

17. A method of racking billiard balls using the billiard ball rack of claim 8, comprising:

aa) unfolding the billiard ball rack from a compact storage position;

bb) connecting the first side arm to the second side arm by coupling the second side arm with the third hinge structure, whereby the second pin of the third hinge structure is inserted inside a groove in the hook structure of the second side arm;

cc) shaping the billiard ball rack into the approximate shape of an equilateral triangle;

dd) aligning and positioning the billiard balls in close proximity to one another on the table in a substantially triangular shape;

ee) positioning the billiard ball rack on top of the billiard balls and pressing down equally on the base arm and side arms, whereby the billiard ball rack automatically adjusts to form the shape of an equilateral triangle;

ff) positioning the billiard ball rack and the billiard balls at a desired location;

gg) pressing down equally on the base arm and side arms, thereby racking the billiard balls into a triangular shape; and hh) removing the billiard ball rack from the billiard balls, whereby the billiard ball rack is lifted vertically while being kept level.

* * * * *